US012757995B2

(12) United States Patent
Zhang

(10) Patent No.: US 12,757,995 B2
(45) Date of Patent: Oct. 13, 2026

(54) STEAM COMB-TOOTHED STRUCTURE AND STEAM COMB

(71) Applicant: Yining Zhang, Shenzhen (CN)

(72) Inventor: Yining Zhang, Shenzhen (CN)

( * ) Notice: Subject to any disclaimer, the term of this patent is extended or adjusted under 35 U.S.C. 154(b) by 0 days.

(21) Appl. No.: 18/812,116

(22) Filed: Aug. 22, 2024

(65) Prior Publication Data

US 2025/0204667 A1 Jun. 26, 2025

(30) Foreign Application Priority Data

Dec. 20, 2023 (CN) ..... 202323479327.5

(51) Int. Cl.
*A45D 24/28* (2006.01)

(52) U.S. Cl.
CPC ..... *A45D 24/28* (2013.01)

(58) Field of Classification Search
CPC ..... A45D 19/16; A45D 24/28; A45D 24/22; A45D 4/10; A45D 4/04
See application file for complete search history.

(56) References Cited

U.S. PATENT DOCUMENTS 7,310,849 B2 * 12/2007 White ..... A46B 5/0025 15/186

FOREIGN PATENT DOCUMENTS

WO WO-2023126601 A1 * 7/2023 ..... A45D 2/002

OTHER PUBLICATIONS

Planterose, English translation of Description, 2021 (Year: 2021).*

* cited by examiner

*Primary Examiner* — Craig M Schneider
(74) *Attorney, Agent, or Firm* — JEEN IP LAW, LLC

(57) ABSTRACT

Disclosed are a steam comb-toothed structure and a steam comb, including electrically heated heating sheets, further including a comb-toothed bottom plate and a cover plate, where the cover plate is installed on the comb-toothed bottom plate, an accommodating cavity is arranged between the cover plate and the comb-toothed bottom plate, and the accommodating cavity is provided with the heating sheets and a heat conducting plate, where water tanks are arranged at corresponding positions of the heat conducting plate; the comb-toothed bottom plate is provided with steam ports, and a through-hole structure for steam passage is arranged on the heat conducting plate; and a space for steam generation is arranged between the cover plate and the heat conducting plate, and the steam generation space is communicated with the steam port.

9 Claims, 7 Drawing Sheets

STEAM COMB-TOOTHED STRUCTURE AND STEAM COMB

CROSS-REFERENCE TO RELATED APPLICATIONS

This application claims priority to Chinese Patent Application No. 202323479327.5, filed on Dec. 20, 2023, which is hereby incorporated by reference in its entirety.

TECHNICAL FIELD

The present disclosure relates to the field of steam combs, and particularly relates to a steam comb-toothed structure and a steam comb.

BACKGROUND

Hair care is an important step of personal image building, and conventional combs that only have the function of hair combing can no longer meet people's needs of hair care. In order to meet the needs of hair care, some people have designed combs with electric heaters that heat comb teeth or comb plates through heating elements, to achieve the effect of hair combing and shaping. However, such combs easily damage the hair and make the hair dry or split.

Later, some people further designed steam combs that use steam for hair shaping. However, steam outlets of such combs are arranged directly in front of comb plates, that is, the steam outlets are directly exposed to the outside. When steam is ejected, it is very likely to scald the human scalp due to improper operation. In addition, a single evaporation path is adopted for steam generating devices of all existing steam combs, and such steam combs feature a short water flow path and a small evaporation area, easily resulting in that water incompletely evaporated flows out of air holes, which might scald the human body. Furthermore, the water flowing out will wet the hair, which is not conducive to hair styling.

SUMMARY

In order to solve the problem in the prior art that steam outlets of existing steam combs are directly exposed to the outside, and when steam is ejected, it is very likely to scald the human scalp, the present disclosure provides a steam comb-toothed structure and a steam comb.

In order to achieve the above objective, the present disclosure, in an aspect, provides a steam comb-toothed structure and a steam comb, including electrically heated heating sheets, further including a comb-toothed bottom plate and a cover plate, where the cover plate is installed on the comb-toothed bottom plate, an accommodating cavity is arranged between the cover plate and the comb-toothed bottom plate, the accommodating cavity is provided with the heating sheets and a heat conducting plate, a lower surface of the heat conducting plate is tightly fitted with an upper end surface of the heating sheet, and water tanks are arranged on the heat conducting plate; the comb-toothed bottom plate is provided with steam ports, and a through-hole structure for steam passage is arranged at a position of the heat conducting plate corresponding to the steam port; a space for steam generation is arranged between the cover plate and the heat conducting plate, and the steam generation space is communicated with the steam port; the cover plate is provided with a water inlet, and the water inlet is communicated with the water tanks on the heat conducting plate; a side of the comb-toothed bottom plate away from the cover plate is provided with a plurality of fixed comb teeth, a side wall of at least one fixed comb tooth among the fixed comb teeth is provided with steam outlets, and the steam outlets are communicated with the steam ports.

Further, the steam comb-toothed structure and the steam comb further include a comb-toothed element and a comb-toothed support, where the comb-toothed element includes a plurality of soft comb teeth and a connecting part configured for connecting each soft comb tooth, each soft comb tooth is provided with a sleeve slot, and the soft comb teeth of the comb-toothed element are sleeved on the fixed comb teeth of the comb-toothed bottom plate in one-to-one correspondence; the comb-toothed support tightly fixes the comb-toothed element on the comb-toothed bottom plate, and a plurality of through holes for passage of each soft comb tooth are formed on the comb-toothed support.

Further, the steam outlet of the fixed comb tooth penetrates through the fixed comb tooth, so that the steam entering the steam outlet from the steam port is divided into two parts, and the two parts of the steam are ejected from both ends of the steam outlet; and when a soft comb tooth is sleeved on a fixed comb tooth provided with a steam outlet, the fixed comb tooth is not blocked, and the comb-toothed element is made of plastic or rubber.

Further, the fixed comb teeth of the comb-toothed bottom plate include a plurality of high fixed comb teeth and a plurality of low fixed comb teeth, and the high fixed comb teeth and the low fixed comb teeth are arranged in a staggered manner; and each soft comb tooth of the comb-toothed element includes a plurality of high soft comb teeth and a plurality of low soft comb teeth, and the high soft comb teeth and the low soft comb teeth are sleeved on the high fixed comb teeth and the low fixed comb teeth in one-to-one correspondence.

Further, the accommodating cavity is further provided with a first sealing silica gel piece and a second sealing silica gel piece, where the first sealing silica gel piece is in an annular shape, the first sealing silica gel piece is tightly arranged between the cover plate and the comb-toothed bottom plate, and the first sealing silica gel piece wraps the heat conducting plate; and the second sealing silica gel piece is tightly arranged between the heat conducting plate and the comb-toothed bottom plate and is located at the position of the steam port, and air holes for steam passage are formed at a position of the second sealing silica gel piece corresponding to the steam port.

Further, the first sealing silica gel piece is provided with a water inlet connector, the water inlet connector penetrates through the water inlet of the cover plate, and the water inlet connector is connected to a water inlet nozzle.

Further, a plurality of the steam ports are arranged, the plurality of steam ports are sequentially arranged along a length direction of the comb-toothed bottom plate, and each steam port is arranged to be located at a middle position of the comb-toothed bottom plate in a width direction.

Further, two heating sheets are arranged, a length direction of these two heating sheets is the same as the length direction of the comb-toothed bottom plate, the two heating sheets are separately arranged on both sides of each steam port, a water tank is separately arranged at positions of the heat conducting plate corresponding to the two heating sheets, the water inlet of the cover plate is arranged at a middle position of the cover plate in a width direction, water inlet passages are arranged at positions of the heat conducting plate corresponding to the water inlet of the cover plate, and two water tanks on the heat conducting plate are both communicated with the water inlet passages.

Further, a partition structure is arranged in the water tank, the partition structure separates the water tank into a plurality of water channels that are communicated with each other sequentially from beginning to end, and the length direction of each water channel is the same as the length direction of the water tank.

In a further aspect, the present disclosure provides a steam comb, and the steam comb has the steam comb-toothed structure.

Compared with the prior art, the present disclosure features the following beneficial effects:

1. When the steam generated by the present disclosure enters the steam outlets of the fixed comb teeth through the steam ports, the steam is divided into two parts by the fixed comb teeth, and then ejected from both ends of the steam outlets horizontally rather than directly, so that scalding the human body by the ejected steam can be effectively avoided, and an action area and using effect of the steam are effectively improved.
2. A partition structure is arranged in the water tank of the heat conducting plate, the partition structure separates the water tank into a plurality of water channels that are communicated with each other sequentially from beginning to end, and the length direction of each water channel is the same as the length direction of the water tank, so that the length of each water channel can be effectively extended, vaporization paths of water flow are expanded, water in the water tank becomes cleaner after vaporization, and non-vaporized high-temperature water is prevented from flowing out to wet the hair and scald the human body.
3. Two water tanks are arranged on the heat conducting plate, water entering from the water inlet nozzle is divided into two parts, and the two parts of water flow into the two water tanks on the heat conducting plate through the two water inlet passages, so that water flow is vaporized more quickly and evenly, thus improving a vaporization effect.
4. In the present disclosure, through matching of the non-metallic soft comb-toothed element with steam flow, hair can be effectively permed and shaped, and the comb-toothed bottom plate is wrapped, so that the problem of scalding is less likely to occur.
5. In the present disclosure, through arrangement of high and low teeth in a staggered manner, and by utilizing differences in the high and low teeth, tangled hair can be effectively combed smoothly.

Figure 1:
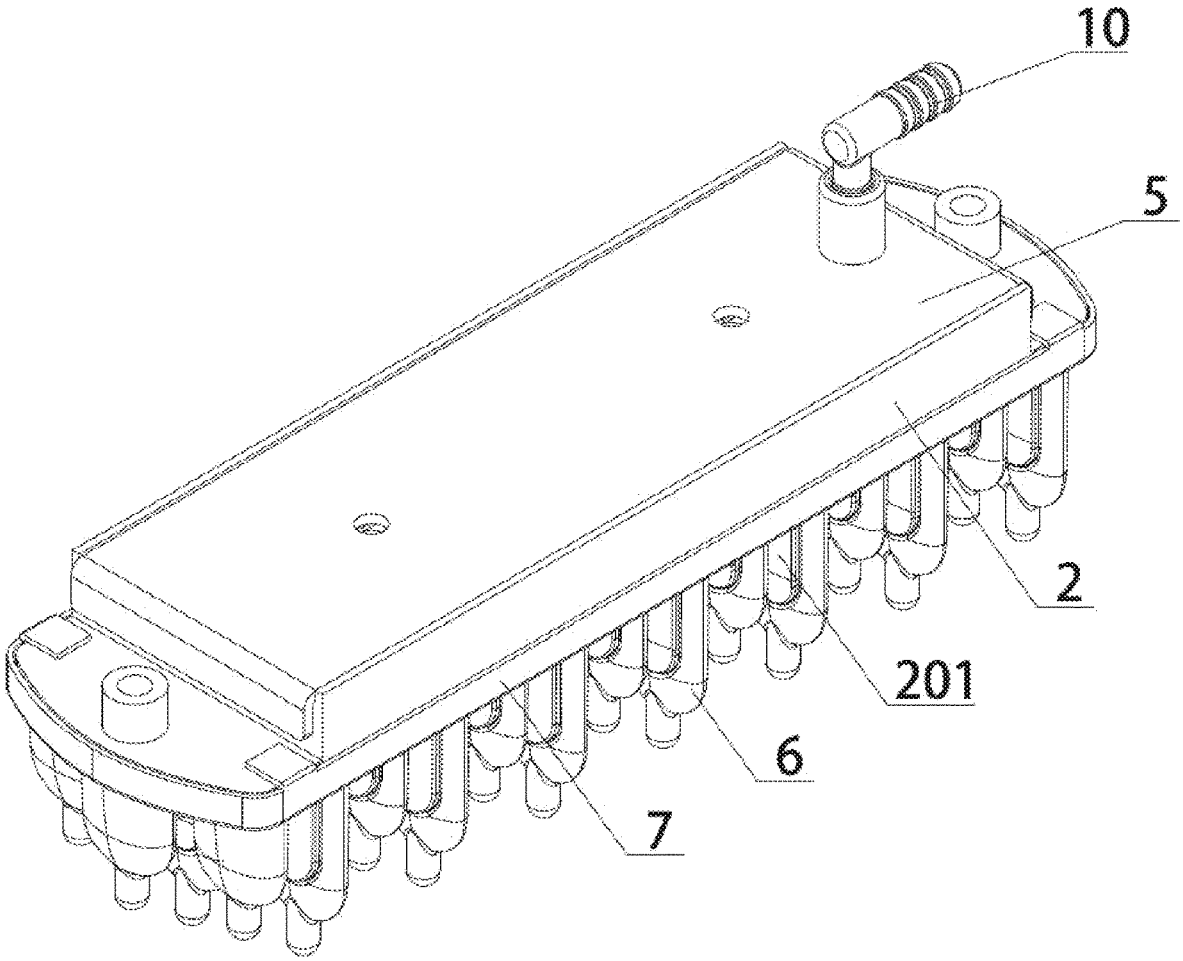
FIG. 1 is a three-dimensional schematic diagram of a steam comb-toothed structure provided by the present disclosure.

In the figures: 1, heating sheet; 2, comb-toothed bottom plate; 201, fixed comb tooth; 202, steam outlet; 3, steam port; 4, heat conducting plate; 5, cover plate; 6, comb-toothed element; 7, comb-toothed support; 8, first sealing silica gel piece; 9, second sealing silica gel piece; 901, air hole; 10, water inlet nozzle; and 11, water tank.

DETAILED DESCRIPTION OF THE EMBODIMENTS

In the present disclosure, unless otherwise explicitly specified and defined, the terms "mounting", "connecting", "connection", "fixing", etc. should be understood in a broad sense, for example, they may be a fixed connection, a detachable connection, or an integrated connection; may be a mechanical connection, or an electrical connection; may be a direct connection, or an indirect connection via an intermediate medium; and may be communication inside two elements, or an interactive relation between two elements. For those of ordinary skill in the art, the specific meanings of the above terms in the present disclosure may be understood according to specific circumstances.

The present disclosure will be further described below with reference to the accompanying drawings and the specific embodiments.

Embodiment 1

A steam comb-toothed structure and a steam comb, as shown in FIGS. 1-4, include electrically heated heating sheets 1, a comb-toothed bottom plate 2, a cover plate 5, a comb-toothed element 6 and a comb-toothed support 7, where the heating sheet 1 can be any one of ceramic heating sheets, mica heating sheets, aluminum foil heating sheets, electrothermal film polyester (PET) heating sheets or thick-film silk screening heating sheets. The cover plate 5 is installed on the comb-toothed bottom plate 2, an accommodating cavity is arranged between the cover plate 5 and the comb-toothed bottom plate 2, and the accommodating cavity is provided with the heating sheets 1, a heat conducting plate 4, a first sealing silica gel piece 8 and a second sealing silica gel piece 9. A lower surface of the heat conducting plate 4 is tightly fitted with an upper end surface of the heating sheet 1, so that heat from the heating sheet 1 can be effectively transferred to the heat conducting plate 4. The comb-toothed bottom plate 2 is provided with four steam ports 3, the four steam ports 3 are sequentially arranged along a length direction of the comb-toothed bottom plate 2, and each steam port 3 is arranged to be located at a middle position of the comb-toothed bottom plate 2 in a width direction. Two heating sheets 1 are arranged, a length direction of these two heating sheets 1 is the same as the length direction of the comb-toothed bottom plate 2, and the two heating sheets 1 are separately arranged on both sides of each steam port 3. A water tank 11 is separately arranged at positions of the heat conducting plate 4 corresponding to the two heating sheets 1, a partition structure is arranged in the water tank 11, the partition structure separates the water tank 11 into a plurality of water channels that are communicated with each other sequentially from beginning to end, and the length direction of each water channel is the same as the length direction of the water tank 11, so that the length of each water channel can be effectively extended, vaporization paths of water flow are expanded, water in the water tank 11 becomes cleaner after vaporization, and non-vaporized high-temperature water is prevented from flowing out and scalding the human body. A space for steam generation is arranged between the cover plate 5 and the heat conducting plate 4, and a through-hole structure for steam passage is arranged at a position of the heat conducting plate 4 corresponding to the steam port 3, so that the steam generation space is communicated with the steam port 3.

Figure 3:
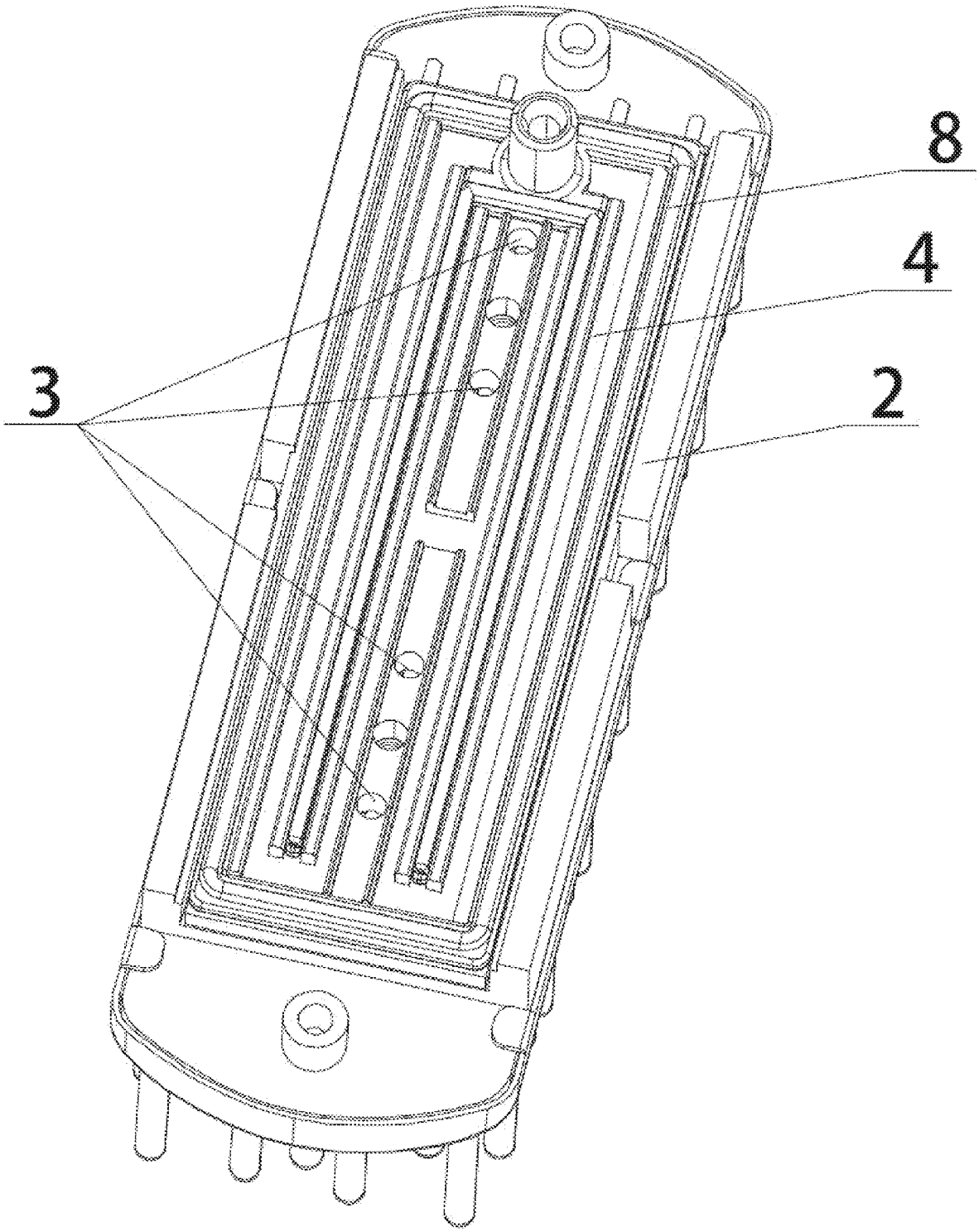
FIG. 3 is a three-dimensional schematic diagram of a steam comb-toothed structure provided by the present disclosure when a cover plate is removed.
Figure 4:
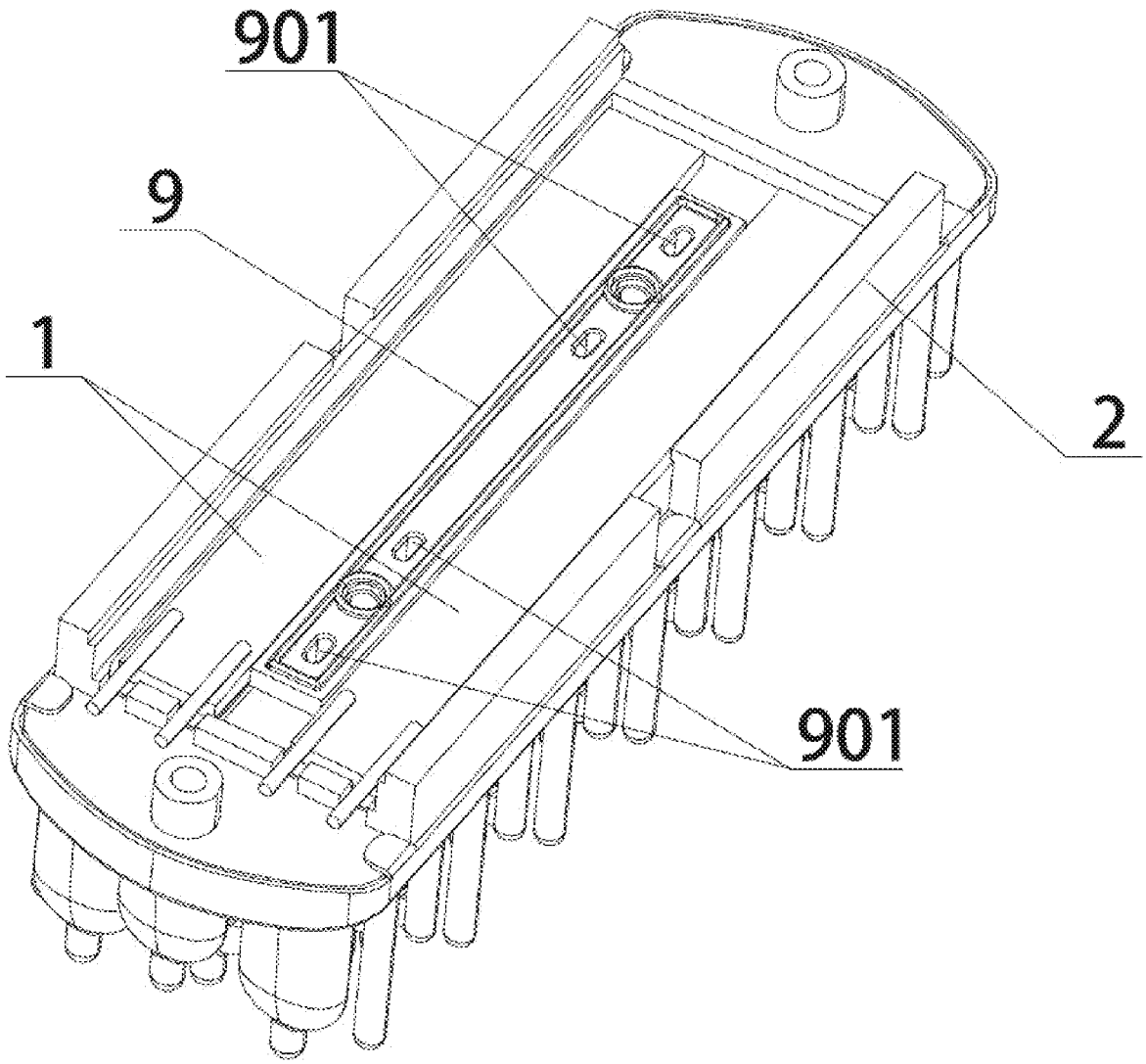
FIG. 4 is a three-dimensional schematic diagram of a steam comb-toothed structure provided by the present disclosure when a cover plate, a heat conducting plate and a first sealing silica gel piece are removed.
Figure 6:
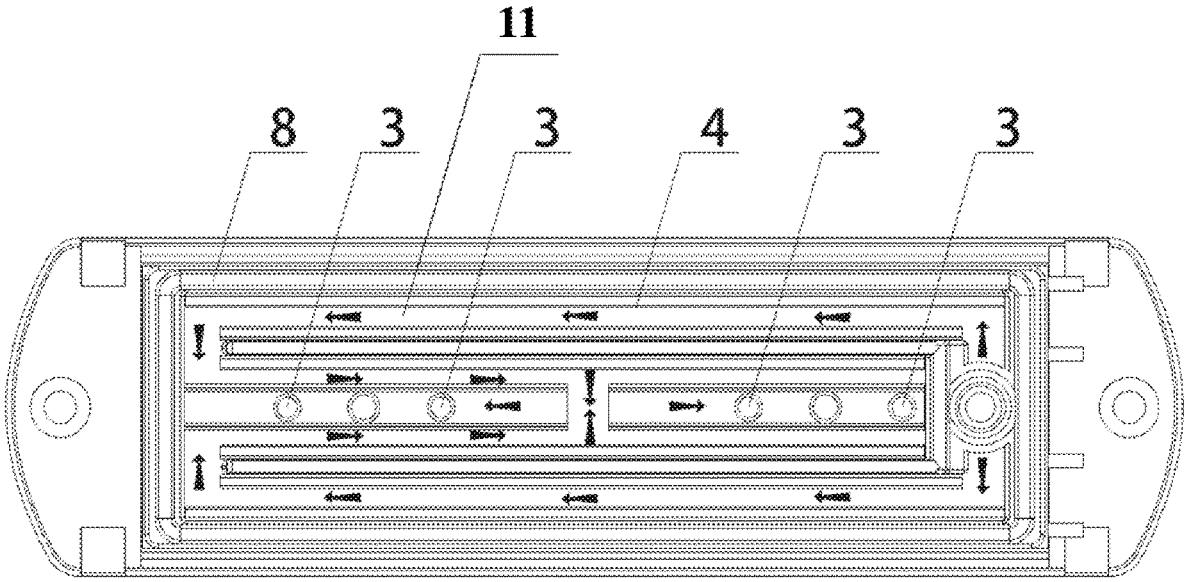
FIG. 6 is a top view of a steam comb-toothed structure provided by the present disclosure when a cover plate is removed, and also a schematic diagram of flow directions of water and steam.

As shown in FIGS. 3, 4 and 6, the first sealing silica gel piece 8 is in an annular shape, the first sealing silica gel piece 8 is tightly arranged between the cover plate 5 and the comb-toothed bottom plate 2, and the first sealing silica gel piece 8 wraps the heat conducting plate 4. The second sealing silica gel piece 9 is tightly arranged between the heat conducting plate 4 and the comb-toothed bottom plate 2 and is located at the position of the steam port 3, air holes 901 for steam passage are formed at a position of the second sealing silica gel piece 9 corresponding to the steam port 3, a vent tube structure is arranged at a position of the air hole 901, and the vent tube structure is inserted into the steam port 3.

Figure 2:
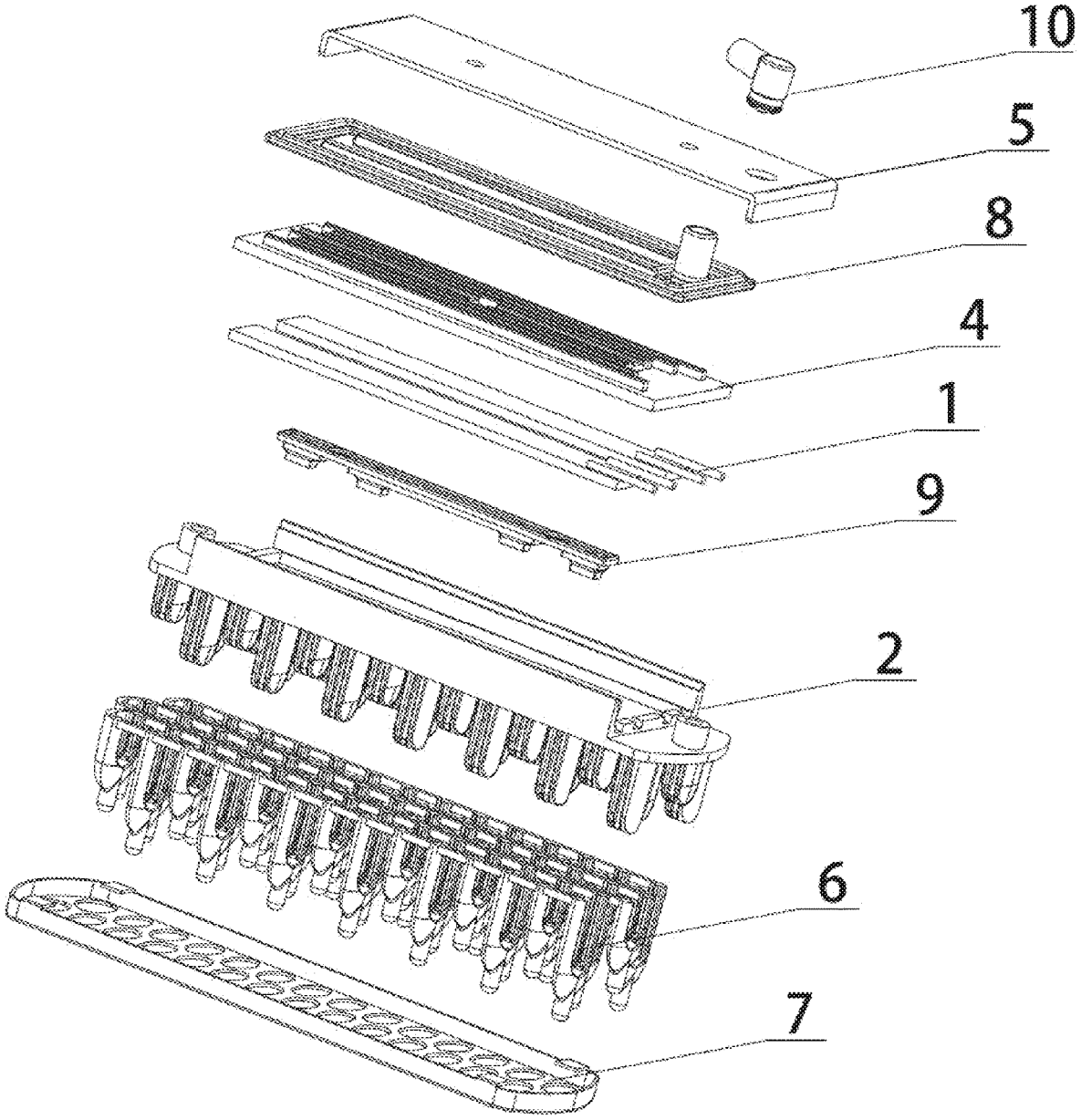
FIG. 2 is a schematic diagram of explosion of a steam comb-toothed structure provided by the present disclosure.

As shown in FIGS. 1 and 2, the cover plate 5 is provided with a water inlet, the first sealing silica gel piece 8 is provided with a water inlet connector, the water inlet connector penetrates through the water inlet of the cover plate 5, and the water inlet connector is connected to a water inlet nozzle 10. The water inlet of the cover plate 5 is arranged at a middle position of the cover plate 5 in a width direction, water inlet passages are arranged at positions of the heat conducting plate 4 corresponding to the water inlet of the cover plate 5 and the water inlet connector of the first sealing silica gel piece 8 separately, and two water tanks 11 on the heat conducting plate 4 are both communicated with the water inlet passages. Water entering from the water inlet nozzle 10 is divided into two parts, and the two parts of water flow into the two water tanks 11 on the heat conducting plate 4 through the two water inlet passages, so that water flow is vaporized more quickly and evenly, thus improving a vaporization effect.

Figure 5:
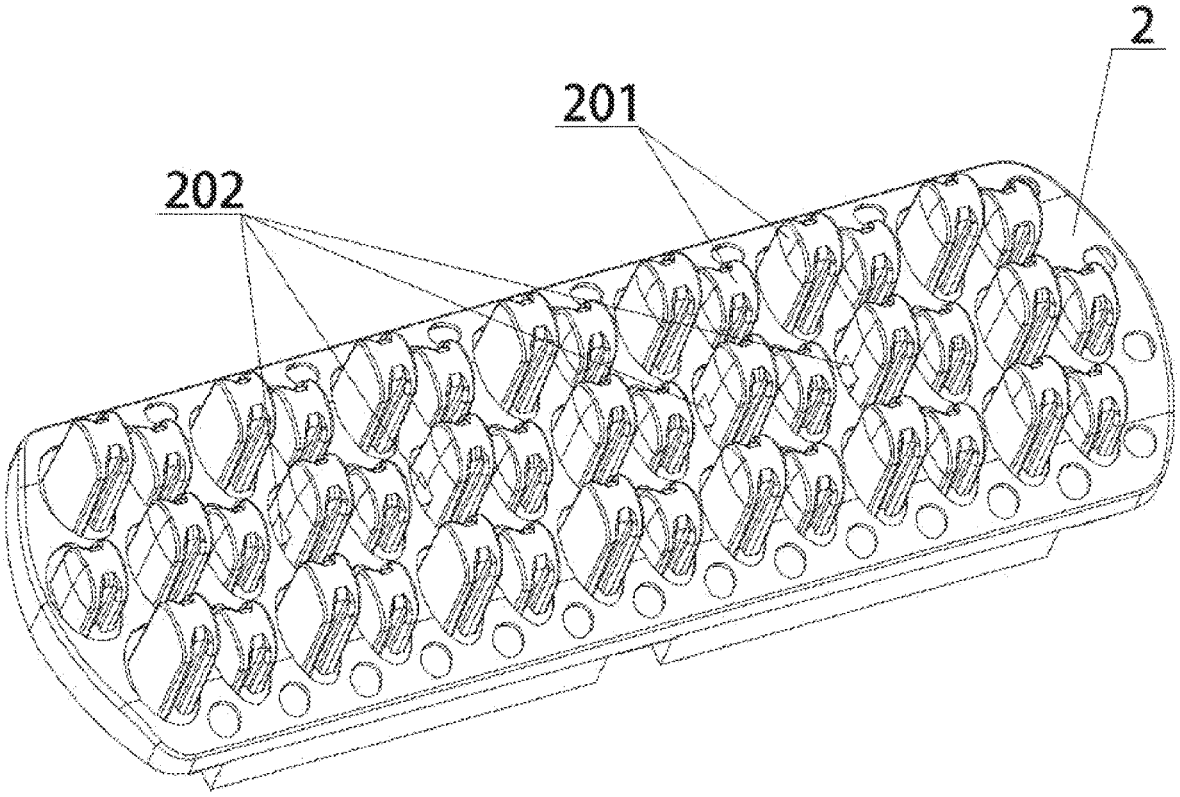
FIG. 5 is a three-dimensional schematic diagram of a comb-toothed bottom plate of a steam comb-toothed structure provided by the present disclosure.

As shown in FIGS. 2 and 5, a side of the comb-toothed bottom plate 2 away from the cover plate 5 is provided with a plurality of fixed comb teeth 201, side walls of four fixed comb teeth 201 corresponding to four steam ports 3 are provided with steam outlets 202, and the steam outlets 202 are communicated with the steam ports 3. The steam outlet 202 of the fixed comb tooth 201 penetrates through the fixed comb tooth 201, so that the steam entering the steam outlet 202 from the steam port 3 is divided into two parts, and the two parts of the steam are ejected from both ends of the steam outlet 202, thereby making a steam path be in a T-shaped air outlet state. The comb-toothed element 6 includes a plurality of soft comb teeth and a connecting part configured for connecting each soft comb tooth, each soft comb tooth is provided with a sleeve slot, and the soft comb teeth of the comb-toothed element 6 are sleeved on the fixed comb teeth 201 of the comb-toothed bottom plate 2 in one-to-one correspondence. When a soft comb tooth is sleeved on a fixed comb tooth 201 provided with a steam outlet 202, the fixed comb tooth 201 is not blocked, and the comb-toothed element 6 is made of plastic or rubber, thus having certain toughness and softness. The comb-toothed support 7 tightly fixes the comb-toothed element 6 on the comb-toothed bottom plate 2, and a plurality of through holes for passage of each soft comb tooth are formed on the comb-toothed support 7. In this way, through matching of the non-metallic soft comb-toothed element 6 with steam, hair can be effectively permed and shaped, and the comb-toothed bottom plate 2 is wrapped, so that the problem of scalding is less likely to occur.

As shown in FIGS. 2 and 5, the fixed comb teeth 201 of the comb-toothed bottom plate 2 include a plurality of high fixed comb teeth and a plurality of low fixed comb teeth, where the length of each of the high fixed comb teeth is greater than the length of each of the low fixed comb teeth, and the high fixed comb teeth and the low fixed comb teeth are arranged in a staggered manner. Each soft comb tooth of the comb-toothed element 6 includes a plurality of high soft comb teeth and a plurality of low soft comb teeth, where the high soft comb teeth and the low soft comb teeth are sleeved on the high fixed comb teeth and the low fixed comb teeth in one-to-one correspondence. Through arrangement of high and low teeth in a staggered manner, and by utilizing differences in the high and low teeth, tangled hair can be effectively combed smoothly.

Figure 7:
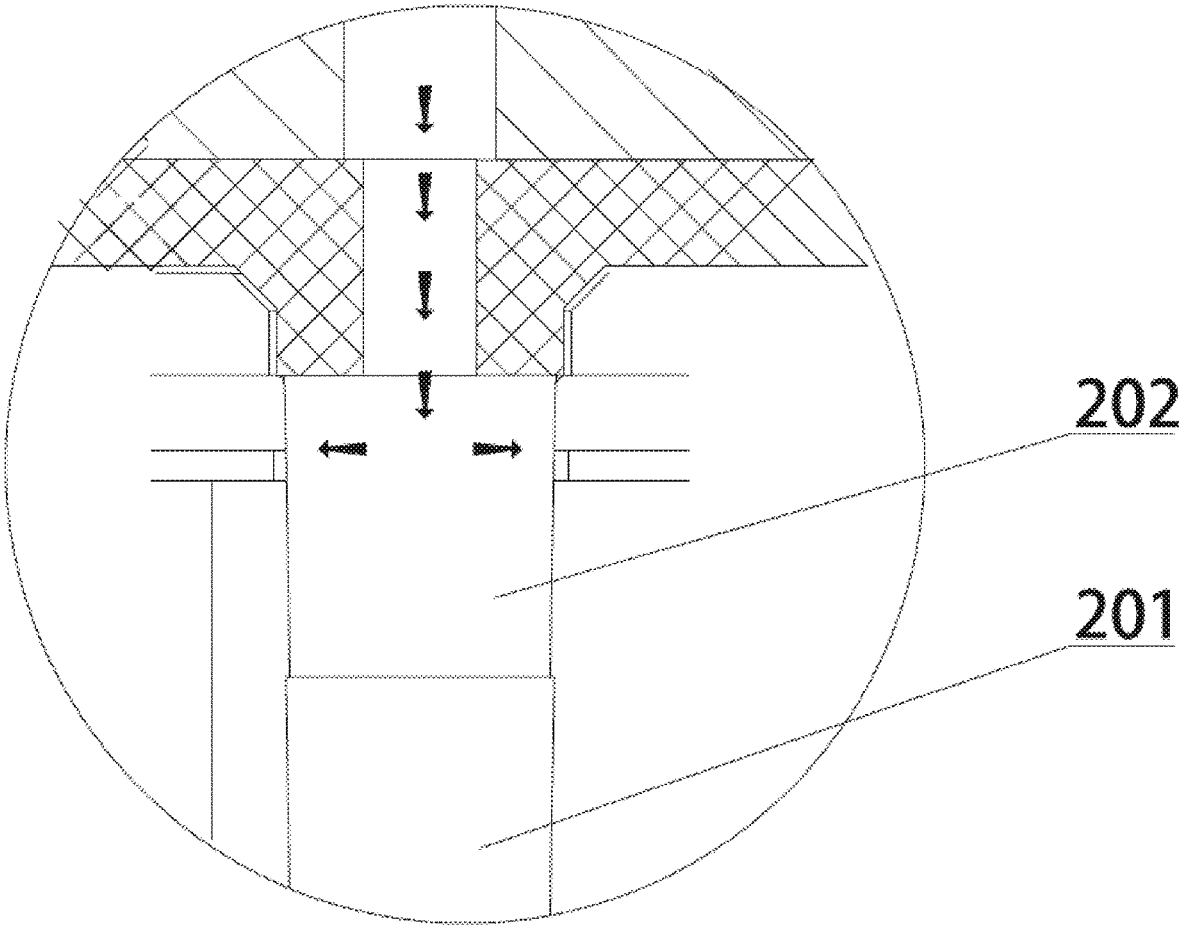
FIG. 7 is a schematic diagram of a flow direction of steam ejected out of a steam outlet of a fixed comb tooth.

Working principle: flow directions of water and steam are indicated by the arrows in FIG. 6 and FIG. 7, and water enters the steam generation space through the water inlet nozzle 10 and flows into the two water tanks 11 on the heat conducting plate 4 through the two water inlet passages. The heating sheets 1 are electrified to generate heat so as to heat the heat conducting plate 4, and then the heat conducting plate 4 heats the water in the water tanks 11 to generate steam. The steam enters the air holes 901 of the second sealing silica gel piece 9 and the steam ports 3 of the comb-toothed bottom plate 2 through the through-hole structure on the heat conducting plate 4, and finally enters the steam outlets 202 of the fixed comb teeth 201, that is, the steam is ejected from the steam outlets 202.

It should be noted that when the steam enters the steam outlets 202 of the fixed comb teeth 201 through the steam ports 3, the steam is divided into two parts by the fixed comb teeth 201, and then ejected from both ends of the steam outlets 202 horizontally rather than directly, so that scalding the human body by the ejected steam can be effectively avoided, and an action area and using effect of the steam are effectively improved.

A steam comb-toothed structure provided in this embodiment can not only be used for steam combs, but also can be used in devices for sterilization, disinfection, hair straightening, hair perming, hair curling, etc.

Embodiment 2

In this embodiment, there is provided a steam comb, and the steam comb is provided with the steam comb-toothed structure provided in Embodiment 1. The steam comb further includes a handle, a water pump, a water tank 11 and other structures, where the water pump and the water tank 11 are both arranged in the handle, the handle is connected to the steam comb-toothed structure provided in Embodiment 1, a suction inlet of the water pump is connected to the water tank 11, a discharge outlet of the water pump is connected to the water inlet nozzle 10 through a pipeline, the water pump inputs the water in the water tank 11 into the water inlet nozzle 10, and then the water enters the steam generation space to generate steam. The handle can also be arranged to control a switch of the water pump and a heating switch of the heating sheet 1, etc.

The above descriptions are only preferred embodiments of the present disclosure and are not intended to limit the present disclosure, and various changes and modifications may be made to the present disclosure by those skilled in the art. Any modifications, equivalent substitutions, improvements, etc. within the spirit and principles of the present disclosure are intended to fall within the scope of protection of the present disclosure.

What is claimed is:

1. A steam comb-toothed structure, comprising electrically heated heating sheets, further comprising a comb-toothed bottom plate and a cover plate, wherein the cover plate is installed on the comb-toothed bottom plate, an accommodating cavity is arranged between the cover plate and the comb-toothed bottom plate, the accommodating cavity is provided with the heating sheets and a heat conducting plate, a lower surface of the heat conducting plate is tightly fitted with an upper end surface of the heating sheet, and water tanks are arranged on the heat conducting plate; the comb-toothed bottom plate is provided with steam ports, and a through-hole structure for steam passage is arranged at a position of the heat conducting plate corresponding to the steam port; a space for steam generation is arranged between the cover plate and the heat conducting plate, and the steam generation space is communicated with the steam port; the cover plate is provided with a water inlet, and the water inlet is communicated with the water tanks on the heat conducting plate; a side of the comb-toothed bottom plate away from the cover plate is provided with a plurality of fixed comb teeth, a side wall of at least one fixed comb tooth among the fixed comb teeth is provided with steam outlets, and the steam outlets are communicated with the steam ports, wherein steam comb-toothed structure further comprises a comb-toothed element and a comb-toothed support, wherein the comb-toothed element comprises a plurality of soft comb teeth and a connecting part configured for connecting each soft comb tooth, each soft comb tooth is provided with a sleeve slot, and the soft comb teeth of the comb-toothed element are sleeved on the fixed comb teeth of the comb-toothed bottom plate in one-to-one correspondence; the comb-toothed support tightly fixes the comb-toothed element on the comb-toothed bottom plate, and a plurality of through holes for passage of each soft comb tooth are formed on the comb-toothed support.

2. The steam comb-toothed structure according to claim 1, wherein the steam outlet of the fixed comb tooth penetrates through the fixed comb tooth, so that the steam entering the steam outlet from the steam port is divided into two parts, and the two parts of the steam are ejected from both ends of the steam outlet; and when a soft comb tooth is sleeved on a fixed comb tooth provided with a steam outlet, the fixed comb tooth is not blocked, and the comb-toothed element is made of plastic or rubber.

3. The steam comb-toothed structure according to claim 2, wherein the fixed comb teeth of the comb-toothed bottom plate comprise a plurality of high fixed comb teeth and a plurality of low fixed comb teeth, and the high fixed comb teeth and the low fixed comb teeth are arranged in a staggered manner; and each soft comb tooth of the comb-toothed element comprises a plurality of high soft comb teeth and a plurality of low soft comb teeth, and the high soft comb teeth and the low soft comb teeth are sleeved on the high fixed comb teeth and the low fixed comb teeth in one-to-one correspondence.

4. The steam comb-toothed structure according to claim 1, wherein the accommodating cavity is further provided with a first sealing silica gel piece and a second sealing silica gel piece, wherein the first sealing silica gel piece is in an annular shape, the first sealing silica gel piece is tightly arranged between the cover plate and the comb-toothed bottom plate, and the first sealing silica gel piece wraps the heat conducting plate; and the second sealing silica gel piece is tightly arranged between the heat conducting plate and the comb-toothed bottom plate and is located at the position of the steam port, and air holes for steam passage are formed at a position of the second sealing silica gel piece corresponding to the steam port.

5. The steam comb-toothed structure according to claim 4, wherein the first sealing silica gel piece is provided with a water inlet connector, the water inlet connector penetrates through the water inlet of the cover plate, and the water inlet connector is connected to a water inlet nozzle.

6. The steam comb-toothed structure according to claim 1, wherein a plurality of the steam ports are arranged, the plurality of steam ports are sequentially arranged along a length direction of the comb-toothed bottom plate, and each steam port is arranged to be located at a middle position of the comb-toothed bottom plate in a width direction.

7. The steam comb-toothed structure according to claim 6, wherein two heating sheets are arranged, a length direction of these two heating sheets is the same as the length direction of the comb-toothed bottom plate, the two heating sheets are separately arranged on both sides of each steam port, a water tank is separately arranged at positions of the heat conducting plate corresponding to the two heating sheets, the water inlet of the cover plate is arranged at a middle position of the cover plate in a width direction, water inlet passages are arranged at positions of the heat conducting plate corresponding to the water inlet of the cover plate, and two water tanks on the heat conducting plate are both communicated with the water inlet passages.

8. The steam comb-toothed structure according to claim 7, wherein a partition structure is arranged in the water tank, the partition structure separates the water tank into a plurality of water channels that are communicated with each other sequentially from beginning to end, and the length direction of each water channel is the same as the length direction of the water tank.

9. A steam comb, wherein the steam comb has the steam comb-toothed structure according to claim 1.

* * * * *